United States Patent [19]

Rudszinat

[11] 4,196,740

[45] Apr. 8, 1980

[54] METHOD AND APPARATUS FOR REGULATING THE FILLING FORCE OF TOBACCO IN CIGARETTES

[75] Inventor: Willy Rudszinat, Dassendorf, Fed. Rep. of Germany

[73] Assignee: Hauni-Werke Körber & Co. KG., Hamburg, Fed. Rep. of Germany

[21] Appl. No.: 939,063

[22] Filed: Sep. 1, 1978

[30] Foreign Application Priority Data

Sep. 8, 1977 [DE] Fed. Rep. of Germany ..... 2740430

[51] Int. Cl.[2] ..... A24C 5/34

[52] U.S. Cl. ..... 131/21 B; 131/21 D

[58] Field of Search ..... 131/21 B, 21 R, 21 D, 131/21 A

[56] References Cited

U.S. PATENT DOCUMENTS

| | | | |
|---|---|---|---|
| 3,127,899 | 4/1964 | Lloyd et al. | 131/21 B |
| 3,595,067 | 7/1971 | Lohe et al. | 131/21 B X |
| 3,604,429 | 9/1971 | De Witt | 131/21 B |
| 3,921,644 | 11/1975 | Lohe et al. | 131/21 B |

*Primary Examiner*—Stephen C. Pellegrino
*Attorney, Agent, or Firm*—Peter K. Kontler

[57] ABSTRACT

The filling force of compacted tobacco in the fillers of filter cigarettes which issue from a filter tripping machine is measured for the purpose of increasing the quantity of tobacco in the filters when the filling force decreases and visce versa. The filling force can be measured by pneumatically deforming successive increments of the wrappers of discrete cigarettes and ascertaining the extent of deformation or by mechanically deforming an entire stack of cigarettes and ascertaining the reduction of the combined volume of cigarettes. The quantity of tobacco can be regulated by removing a larger or smaller quantity of tobacco from a continuous stream which is thereby converted into the filler of a cigarette rod or by changing the speed of a conveyor in the distributor of the cigarette making machine so that the conveyor withdraws a larger or smaller quantity of tobacco per unit of time. The measurement of the filling force is carried out with a delay following severing of the cigarette rod so as to enable the filling force to rise to a value which is at least close to the final value. In addition to regulation of the quantity of tobacco in the fillers of cigarettes in response to ascertainment of the filling force, such quantity is further regulated when it deviates from a preselected value. The necessary measurements are carried out by a beta ray detector which is adjacent the path of the cigarette rod.

39 Claims, 3 Drawing Figures

METHOD AND APPARATUS FOR REGULATING THE FILLING FORCE OF TOBACCO IN CIGARETTES

BACKGROUND OF THE INVENTION

The present invention relates to a method and apparatus for regulating the filling force of elastically deformable particulate materials which constitute the fillers of cigarettes, cigarillos, cigars and/or other rod-shaped articles which, in turn, constitute or form part of smokers' products. More particularly, the invention relates to improvements in a method and apparatus for adjusting the feed of tobacco or other smokable particulate material in cigarette making and analogous machines for the purpose of insuring that the pressure (filling force) which the confined particulate material applies against the internal surface of the tubular wrapper of a cigarette or the like will be maintained within a desired range. Still more particularly, the invention relates to improvements in a method and apparatus for regulating the quantity of elastically deformable particulate smokable material in a stream which is about to be draped into a web of cigarette paper or the like to constitute the filler of a continuous rod which is thereupon severed to yield discrete cigarettes or analogous rod-shaped articles of unit length or multiple unit length.

The definition "smokable particulate material" embraces natural tobacco, reconstituted tobacco, artificial tobacco made of cellulose or the like, and mixtures of such substances. The material can be rendered particulate by shredding, slitting, tearing or by resorting to any other suitable comminuting technique. The rod-shaped articles which contain smokable particulate material may constitute plain or filter tipped cigars, cigarillos or cigarettes. For the sake of simplicity, the invention will be described with reference to the production of plain and filter cigarettes; however, it will be understood that the invention can be practiced in conjunction with the manufacture of any and all types of rod-shaped articles which constitute or form part of smokers' products and which involves the confinement of a continuous stream of particulate smokable material into a wrapper prior to subdivision of the resulting continuous wrapped stream into discrete rod-shaped articles of desired length.

In the manufacture of cigarettes in conventional cigarette making machines, a continuous stream of tobacco is transported lengthwise on to a wrapping station where the stream is draped into a continuous web of cigarette paper. As a rule, the stream is trimmed ahead of the wrapping station and is thereby converted into a trimmed stream or filler having a constant or substantially constant cross-sectional area. The trimming device removes the surplus from an uneven side of the stream which is transported in the groove of an endless conveyor in the form of a belt, wheel or the like. It is customary to monitor the quantity of tobacco in the stream and to change the quantity of tobacco per unit length of the stream when the monitored quantity deviates from a desired value. In many instances, the monitoring means includes a source of corpuscular radiation (e.g., a source of beta rays) and an ionization chamber. It is also known to employ monitoring devices which embody a system of capacitors. The quantity of tobacco per unit length of the stream can be changed by resorting to one or more trimming or equalizing devices with rotary knives which are movable relative to the stream to remove a variable quantity of tobacco, i.e., a quantity which is a function of the difference between the measured quantity and the desired quantity of tobacco per unit length of the stream. Alternatively, the quantity of tobacco in the stream can be varied by adjusting the distributor which draws tobacco from a source of supply and converts the withdrawn tobacco into a continuous stream. As a rule, the distributor is designed to convert withdrawn tobacco particles into a relatively wide and thin sliver or carpet which is thereupon converted into a narrow stream. The aforementioned adjustment may involve regulation of the rate at which the distributor draws tobacco particles from the source of supply.

The desired or preferred mode of operation of those parts of a cigarette making machine which form the continuous tobacco stream is such that each finished article (plain cigarette) contains a predetermined quantity for tobacco particles. The weight of the filler of a cigarette cannot be reduced below a predetermined minimum value; therefore, and in order to achieve savings in tobacco, the manufacturers of cigarettes strive to produce cigarettes wherein the weight of the tobacco filler matches or is only slightly above the minimum permissible weight. However, two cigarettes of identical weight (the weight of the tubular wrapper is negligible and can be disregarded) can exhibit different characteristics, especially as concerns the "feel" of the cigarette in the hand of a smoker. Thus, a cigarette wherein the weight of the filler matches a desired value can create the impression of a densely packed article by offering a pronounced resistance to deformation in response to the application of a pinching or squeezing force against the exterior of the wrapper. Such cigarettes are preferred by a great majority of the smokers. On the other hand, a cigarette wherein the weight of the filler is identical with the weight of a "densely packed" cigarette can create the impression of a soft and readily deformable rod whose wrapper will yield to minute finger pressure. The differences between "densely packed" and "soft" cigarettes are attributable to the condition of tobacco particles which constitute the filler. The main factor is the elasticity of tobacco particles and such elasticity, in turn, depends on the length of tobacco particles (shreds) and/or the crimp of the particles. Thus, a cigarette wherein the filler consists of relatively long shreds which exhibit a pronounced crimp will invariably create the impression of a densely packed product when compared with a cigarette having a filler of identical weight but containing a higher percentage of short tobacco and/or straight (uncrimped) shreds. Therefore, in addition to monitoring the quantity (weight) of tobacco per unit length of the stream (normally a trimmed stream or filler) which is to be draped into a web of cigarette paper, many manufacturers of tobacco further resort to measurement of the filling force of the filler of a finished cigarette, i.e., to the testing of cigarettes in order to ascertain the force with which the compacted filler of a cigarette bears against the internal surface of its wrapper. The results of such measurements are used to vary the quantity of tobacco per unit length of the stream, i.e., to insure that a cigarette whose filler consists of short tobacco and/or only slightly curled or crimped tobacoo will contain more tobacco than a cigarette wherein the filler consists of tobacco particles which are crimped and constitute or include a high percentage of long shreds. Of course, and even if the filler consists of highly satisfactory (long and crimped) tobacco particles, the quantity per unit length of the stream cannot be reduced to such an extent that the weight of the filler of a cigarette would be less than the minimum permissible weight (i.e., less than the lower threshold value of the acceptable range of weights).

The monitoring of filling force of the fillers of cigarettes is normally carried out in a laboratory. Such monitoring involves the testing of a relatively small percentage of the total output of a cigarette maker and is desirable not only when the maker processes different types of tobacco but also when the maker is set to produce a given brand of cigarettes wherein the filler consists of a given type of tobacco. The reason is that, even during such mode operation, the quality of tobacco particles which form the stream is likely to undergo rather pronounced changes, i.e., the length of the shreds and/or the extent of crimp of the shreds is likely to undergo long-range variations above and below the desired optimum value.

The presently known methods of ascertaining the filling force of fillers in cigarettes are time-consuming and must be practiced by resorting to skilled labor. Moreover, and since the samples are withdrawn at intervals and must be transferred into a laboratory, the known methods do not allow for immediate or practically immediate adjustment of the filling force when the measured filling force is unsatisfactory.

It is further known to equip a cigarette making machine with apparatus which can automatically ascertain the filling force of successive increments of a continuous tobacco stream. Reference may be had to U.S. Pat. No. 3,595,067 granted July 27, 1971 to von der Lohe et al. The apparatus which is disclosed in this patent can ascertain the filling force of a filler prior to subdivision of the wrapper filler into discrete cigarettes. Moreover, the apparatus can achieve accurate measurements of the filling force. However, the nature of measurements and of the signals which are indicative of the measured value of the filling force is such that the results of measurements cannot be readily utilized for automatic adjustment of the machine for the purpose of maintaining the filling force of the fillers of cigarettes within a desired range.

OBJECTS AND SUMMARY OF THE INVENTION

An object of the invention is to provide a novel and improved method of ascertaining the filling force of the fillers of cigarettes or the like in such a way that the results of tests can be readily utilized for adjustment of the quantity of particulate material in the fillers when the measured filling force deviates from a desired filling force.

Another object of the invention is to provide a method which can be resorted to for ascertaining the filling force of fillers of successive or selected discrete rod-shaped articles, of the entire output of a machine for the mass-production of cigarettes or the like, or of a desired percentage of the total output.

A further object of the invention is to provide a novel and improved method of regulating the quantity of smokable particulate material in a stream which is to be converted into the fillers of cigarettes or the like for the purpose of insuring that the filling force of tobacco in the cigarettes will match or closely approximate a desired optimum filling force.

An additional object of the invention is to provide a novel and improved apparatus which can be utilized for the practice of the above outlined method and which can automatically adjust the quantity of tobacco and/or other smokable material in the fillers of cigarettes or analogous rod-shaped articles in order to insure that the filling force of the filler of each article will match or closely approximate an optimum value.

Another object of the invention is to provide the apparatus with novel and improved means for simultaneously ascertaining the filling force of plural rod-shaped articles.

A further object of the invention is to provide the apparatus with novel and improved means for adjusting the quantity of particulate material in the fillers of finished articles in dependency on several factors including the filling force of the fillers.

Another object of the invention is to provide an apparatus which can be readily incorporated in existing machines for the mass-production of plain or filter tipped cigarettes, cigars or cigarillos.

An additional object of the invention is to provide an apparatus which is relatively simple, which requires little or no attention on the part of the attendants, and which can be readily adjusted to select the desired filling force.

An ancillary object of the invention is to provide the apparatus with novel and improved means for evaluating the results of measurements of the filling force of the fillers of cigarettes or the like.

One feature of the invention resides in the provision of a method of processing elastically deformable particulate material, especially tobacco (e.g., tobacco shreds which are to be converted into fillers of plain or filter tipped cigarettes). The method comprises the steps of converting smokable material into a continuous stream (e.g., a filler stream of the type formed in a cigarette making machine for wrapping in cigarette paper), moving the stream lengthwise, compacting the moving stream and applying around the moving compacted stream a continuous wrapper whereby the material of the compacted stream tends to expand and exerts a force against the interior of the applied wrapper (for example, the compacting step can be carried out in the wrapping mechanism of a cigarette making machine wherein a rod-like filler stream of tobacco shreds is transported by a garniture during draping of a web of cigarette paper therearound), subdividing the moving wrapped stream into discrete rod-shaped articles of unit length or multiple unit length while the filling force is on the increase, at least at times, toward a final value, measuring the filling force in at least some articles with a delay which follows the completion of the subdividing step and is long enough to allow the filling force to reach a value sufficiently close to the final value for ascertainment of the final value on the basis of the measured value of the filling force, and regulating the quantity of material in the stream prior to wrapping as a function of variations of the measured value of the filling force. The regulating step includes reducing the quantity of material when the measured value of the filling force increases and vice versa.

The aforementioned delay is at least one second and preferably more than three seconds; this insures that the filling force increases to a value which matches or is sufficiently close to the final value prior to start of the measuring or testing step. During the interval between severing and testing, the articles can be provided with rod-like components, e.g., with filter plugs or mouthpieces and can be stacked or otherwise arrayed in orderly fashion for further processing and/or for introduction into the testing station.

The measuring step may include testing a fraction of the total number of articles which the trapped stream yields as a result of the subdividing step. For example, discrete articles which are obtained as a result of the subdividing step can be conveyed along a predetermined path (e.g., in the form of a single row wherein the articles move sideways); the measuring step then comprises testing each n-th article of the row, preferably by removing each n-th article from the row and transferring the removed article to the testing station.

The testing step may comprise directing a stream of pressurized fluid (e.g., compressed air) against the exterior of the wrappers of the articles which are chosen for testing and monitoring the extent of deformation of the wrappers under the action of the fluid stream.

In accordance with a presently preferred embodiment of testing selected (e.g., n-th) articles, the measuring or testing step comprises testing successive increments of articles and generating first signals denoting the filling force of each tested increment of an article under test. The method then further comprises (or preferably comprises) the step of generating a second signal denoting the average intensity or another characteristic of first signals which are obtained on testing of a given article, and the regulating step then comprises varying the quantity of material in the stream as a function of the extent of deviation of the intensity of each second signal from a reference signal of predetermined or variable intensity.

The measuring step may comprise simultaneously testing a plurality of articles; the testing step then preferably comprises simultaneous application of a deforming stress to a plurality of articles (e.g., a deforming stress applied by a weight which is allowed to descend onto a stack or another orderly array of articles which together constitute a plurality of articles), and monitoring the changes of the combined volume of such plurality of articles in response to the application of the deforming stress.

The regulating step may comprise removing from the stream material at a rate which is a function of the measured value of the filling force. For example, the stream can be transported toward the compacting station in such a way that it contains a surplus of particulate material, and such surplus is removed by a trimming or equalizing device which is adjustable in dependency on the measured value of the filling force so that it removes more material when the measured value of the filling force increases and vice versa.

Alternatively, the converting step may comprise forming a continuous carpet of sliver of smokable material (e.g., in the distributor of a cigarette making machine) and converting the carpet into the aforementioned continuous stream of smokable particulate material. The regulating step then comprises (or may comprise) varying the quantity of material per unit length of the carpet or sliver as a function of measured value of the filling force. This can be achieved by driving a conveyor of the distributor at a speed which varies as a function of variations of the measured value of the filling force.

The method may further comprise the steps of generating first signals which denote the quantity of material per unit length of the moving stream and comparing the first signals with a reference signal denoting the desired quantity of material per unit length of the moving stream. The regulating step then further comprises varying the quantity of material in the moving stream when a first signal deviates from the reference signal or when the average value of a series of first signals deviates from the reference signal. The step of generating first signals may comprise directing a beam of corpuscular radiation (e.g., beta rays) transversely of and against successive increments of the moving stream and monitoring the intensity of radiation which penetrates through the respective increments of the stream. Alternatively, the step of generating first signals may include a capacitive or other suitable measurement of the quantity of material per unit length of the moving stream. The measuring step may comprise generating third signals which denote the filling force of tested articles and the regulating step may comprise modifying the reference signal when the intensity of the third signal deviates from a predetermined value denoting a desired filling force. The arrangement is preferably such that the modifying step includes increasing the intensity of the reference signal when the intensity of the third signal is below the predetermined value, and vice versa. The modifying step is preferably interrupted when the measured quantity of material drops to a predetermined lower threshold value; this insures that the quantity of smokable material per unit length of the finished articles cannot be reduced below a minimum permissible value regardless of whether or not the filling force is higher than desired.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
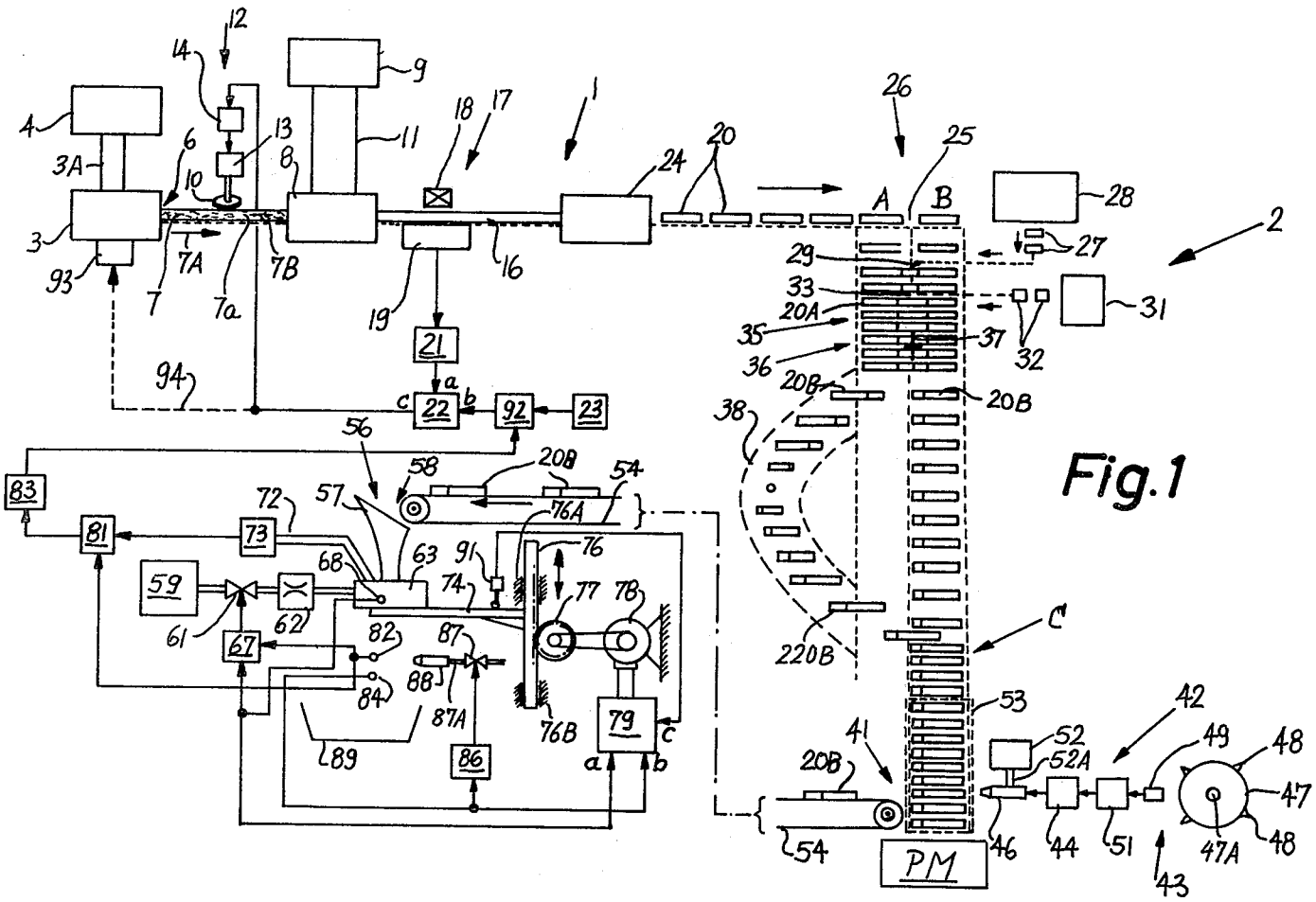
FIG. 1 is a schematic plan view of a portion of a production line including a cigarette making machine and a directly coupled filter tipping machine and embodying an apparatus which is constructed and assembled in accordance with a first embodiment of the invention, the apparatus being designed to ascertain the filling force of fillers of discrete filter cigarettes.

FIG. 1 shows a portion of a production line including a cigarette making machine 1 and a filter tipping machine 2 which is directly coupled to the machine 1. The machine 1 is of the type known as "GARANT" (trademark) produced by Hauni-Werke Körber & Co. KG., of Hamburg, Federal Republic Germany, and the machine 2 is of the type known as "MAX", also produced by Hauni-Werke. For the sake of clarity, FIG. 1 merely shows those component parts of the two machines which are important for full understanding of the invention.

The cigarette making machine 1 comprises a distributor 3 (e.g., a distributor of the type disclosed in commonly owned U.S. Pat. No. 3,996,944 granted December 14, 1976 to Alfred Hinzmann). The distributor 3 comprises a conveyor 3A (e.g., a carded drum) for drawing elastically deformable particles of smokable material (assumed to be tobacco shreds) from a suitable source of supply 4, e.g., a magazine or a duct whose discharge end is disposed above the apex of the carded drum 3A. The distributor 3 comprises means, e.g., a customary endless apron conveyor at a converting station 6, for converting the withdrawn tobacco particles into a relatively thin and wide carpet or sliver which is thereupon converted into a continuous stream 7 containing a surplus of tobacco particles. The stream 7 is narrow and its cross-sectional area exceeds the cross-sectional area of the filler of a finished cigarette. The means for transporting the stream 7 in the direction of arrow 7A comprises an endless belt conveyor 7B which advances the stream 7 past a material removing station accommodating a regulating unit here shown as a trimming or equalizing device 12. The device 12 comprises one or more rotary knives 10 which are movable at right angles to the direction of transport of the stream 7 to remove the surplus and to convert the stream 7 into a trimmed stream of filler *7a* ready to be wrapped into a web 11 of cigarette paper or the like. The device wherein the trimmed stream or filler *7a* is confined in the web 11 is shown at 8; this device comprises means for compacting or condensing the filler *7a* so that it constitutes a rod which tends to expand and thereby exerts a force against the internal surface of the tubular wrapper*. In a manner known per se, the web 11 is drawn off a bobbin 9 and one of its marginal portions is coated with adhesive which is supplied by a conventional paster. The wrapping device 8 comprises a customary garniture which folds the marginal portions of the web over each other so that the marginal portions adhere to each other and form an elongated seam extending lengthwise of the resulting continuous cigarette rod 16 (wrapped stream *7a*). The wrapping device 8 may further comprise or may be associated with a conventional sealer which promotes the setting of adhesive in the seam by cooling the seam if the adhesive is a hotmelt and by heating the seam if the adhesive is a wet adhesive which sets in response to the application of heat. The aforementioned belt conveyor 7B is preferably made of foraminous material and travels along a suction chamber which causes the particles of the streams 7 and *7a* to adhere to the respective surface of the conveyor 7B during transport to the wrapping device 8.

*A suitable wrapping mechanism which compacts the filler is disclosed in U.S. Pat. No. 3,030,965 (FIG. 8-15).

The equalizing device 12 further comprises a reversible motor 13 which can move the knife or knives 10 toward or away from the conveyor 7B to thereby change the quantity of tobacco particles per unit length of the stream *7a*. The removed surplus is preferably returned to the source of supply 4 in a manner not specifically shown in FIG. 1. The reference character 14 denotes a control circuit which transmits appropriate signals to the motor 13 in order to move the knife or knives 10 toward or away from the path of movement of the stream 7. A trimming or equalizing device which can be used in the cigarette making machine 1 is disclosed, for example, in commonly owned U.S. Pat. No. 3,261,366 granted July 19, 1966 to Willy Richter et al.

The means for monitoring the quantity of tobacco per unit length of the stream *7a* upstream of the wrapping device 8 comprises a detector 17 including a source 18 of corpuscular radiation (e.g., beta rays) and an ionization chamber 19. The parts 18 and 19 are disposed opposite each other at the opposite sides of the path for the stream *7a*, and the ionization chamber 19 transmits signals whose intensity or another characteristic is proportional to the intensity of corpuscular radiation which penetrates through successive increments or unit lengths of the continuously moving stream *7a*. The signals at the output of the ionization chamber 19 are transmitted to the corresponding input of an integrating circuit 21 whose output transmits a signal (denoting the actual quantity of tobacco per given length of the stream *7a*) to the input a of a signal comparing stage 22. The input b of the signal comparing stage 22 receives a reference signal which is transmitted by a preferably adjustable source 23 of reference signals (e.g., a potentiometer). The reference signal which is applied to the input b of the signal comparing stage 22 denotes the desired (optimum) quantity of tobacco particles per given length of the stream *7a*. The connection between the output of the source 23 and the input b of the signal comparing stage 22 comprises a signal modifying circuit 92 (preferably a subtracting circuit) which can modify the reference signal in dependency on the monitored filling force of finished rod-shaped articles. The output c of the signal stage 22 transmits a signal which represents the difference between the intensities of signals transmitted to the inputs a and b of the stage 22, and such output signal is transmitted to the control circuit 14 for the motor 13 to effect appropriate adjustment of the knife or knives 10 in dependency on the monitored quantity of tobacco in the stream *7a*. The adjustment is such that the knife or knives 10 are moved upwardly (as viewed in FIG. 1) when the monitored quantity of tobacco particles in the stream *7a* is less than the desired quantity, and vice versa. In other words, the control unit 14 insures that the quantity of tobacco in the stream *7a* matches or closely approximates the quantity which is denoted by the reference signal furnished to the input b of the signal comparing stage 22.

The cigarette making machine 1 further comprises a device 24 (commonly known as cutoff) which severs the continuous cigarette rod 16 at regular intervals so that the rod 16 yields a file of discrete plain cigarettes 20 of unit length or multiple unit length. It is assumed that each cigarette 20 is of unit length. The cutoff 24 comprises one or more orbiting knives which move forwardly (arrow 7A) at the speed of the rod 16 during severing and thereupon move backwards on their way into renewed severing engagement with the rod 16. A suitable cutoff is disclosed in commonly owned U.S. Pat. No. 3,518,911 granted July 7, 1970 to Helmut Niemann et al.

Successive plain cigarettes 20 are propelled into successive flutes of a rotary drum-shaped row forming conveyor which forms part of the filter tipping machine 2 and is mounted at a row forming station 26. The conveyor converts the single file of plain cigarettes 20 into two rows A and B wherein the cigarettes move sideways and wherein each cigarette 20 of the row A is in axial alignment with but is spaced from a cigarette 20 of the row B. The gaps between pairs of coaxial cigarettes 20 of the rows A and B are shown at 25; the width of such gaps at least equals but preferably at least slightly exceeds the length of a filter mouthpiece or plug 27 of double unit length. These filter plugs are supplied by a filter making machine 28 which includes means for supplying a single row of registering filter plugs 27 to an inserting station 29 where each plug enters the gap 25 between two aligned cigarettes 20 of the rows A and B so that each plug 27 constitutes one component of a group of three coaxial rod-like components including two plain cigarettes 20 and a plug 27 therebetween.

The filter tipping machine 2 further comprises or is associated with a device 31 which supplies a single file of adhesive-coated uniting bands 32 serving to connect each filter plug 27 with the adjacent end portions of the respective plain cigarettes 20 so as to convert the respective group into a filter cigarette 20A of double unit length. The attachment of uniting bands 32 to the respective groups takes place at a station 33 downstream of the inserting station 29 (as considered in the direction of movement of cigarettes 20 forming the rows A and B). The manner in which the uniting bands 32 are formed by coating a continuous web of artificial cork or the like with adhesive and by severing the web to yield discrete uniting bands is well known in the art. Reference may be had to commonly owned U.S. Pat. No. 3,962,957 granted June 15, 1976 to Alfred Hinzmann.

The means for convoluting each uniting band 32 about the respective filter plug 27 and the inner end portions of the corresponding plain cigarettes 20 is installed at a rolling station 35 which is located downstream of the station 33 and may accommodate an apparatus of the type disclosed in the commonly owned U.S. Pat. No. 3,527,234 granted Sept. 8, 1970 to Alfred Hinzmann. For example, the rolling station 35 may accommodate a rotary drum-shaped conveyor which advances the groups (each of which carries a uniting band) past a stationary or mobile rolling surface which defines with the drum a gap having a width less than the diameter of a filter plug 27. This causes the groups to rotate about their respective axes whereby the uniting bands 32 are convoluted around the filter plugs 25 and the inner end portions of the associated plain cigarettes 20.

The thus obtained filter cigarettes 20A of double unit length are severed seriatim by a rotary disk-shaped knife 37 so that each cigarette 20A yields two coaxial filter cigarettes 20B of unit length. The knife 37 is installed at a severing station 36. The filter cigarettes 20B of the row A are thereupon inverted end-for-end by a turn around device 38, e.g., a device of the type disclosed in commonly owned U.S. Pat. No. 3,583,546 granted June 8, 1971 to Gerhard Koop. The device 38 places the inverted cigarettes 20B of the row A between the non-inverted cigarettes 20B of the row B so that the filter plugs 220B of all cigarettes 20B face in the same direction and the inverted and non-inverted cigarettes 20B form a single row C which advances downwardly, as viewed in FIG. 1, i.e., all cigarettes 20B move sideways and are in accurate register with each other. The cigarettes 20B which form the row C are transported on to a packing machine PM (e.g., a machine of the type disclosed in commonly owned U.S. Pat. No. 3,805,477 granted Apr. 23, 1974 to Friedel Kruse et al.), or to another processing station.

In accordance with a feature of the invention, there is further provided a withdrawing or transferring device 41 which can remove selected (n-th) cigarettes 20B from the row C at a withdrawing station or transfer station 41 at which the row C advances in the flutes of a rotary drum-shaped conveyor 53. The withdrawing or transferring device 42 comprises a timer 43 which effects the withdrawal of each nth (e.g., each 1000th or 5000th) cigarette 20B from the path for the row C. The signal at the output of the timer 43 is transmitted to a solenoid-operated valve 46 which directs a jet of compressed air against the end face of the adjacent cigarette 20B in the row C to thereby transfer such cigarette onto the upper reach of a belt conveyor 54 serving to deliver the thus withdrawn cigarette to the testing station. The valve 46 is installed in a conduit 52A which communicates with a suitable source 52 of compressed air, and the orifice of the nozzle of the valve 46 faces the adjacent end faces of cigarettes 20B in the row C, i.e., of cigarettes in the flutes of the conveyor 53.

The timer 43 comprises a disk 47 which is driven in synchronism with moving parts of the filter tipping machine 2 and has an annulus of pulse generating pins 48 travelling past a proximity switch 49 which transmits signals to a control circuit 44 via amplifier 51. The step-down ratio between the prime mover (not shown) of the filter tipping machine 2 and the shaft 47A of the disk 47 is selected in such a way that the valve 46 expels from the row C each nth cigarette 20B, e.g., each 1000th or 5000th cigarette of the row C.

The belt conveyor 54 derives motion from the prime mover of the filter tipping machine 2 and is sufficiently long to insure that the cigarettes 20B which have been chosen for testing remain on its upper reach for a selected interval of time so that the length of the interval which elapses between the compacting of the filler of such cigarette in the wrapping device 8 (or between the separation of the respective cigarette from the rod 16 by a knife of the cutoff 24) exceeds a predetermined minimum interval, e.g., at least one second but preferably three or more seconds.

The testing or measuring device 56 receives selected cigarettes 20B from the discharge end 58 of the belt conveyor 54 and is designed to ascertain the filling force of the fillers of cigarettes 20B which are delivered thereto by the conveyor 54. The purpose of the delay which is achieved by causing the selected cigarettes 20B to travel with the upper reach of the belt conveyor 54 is to insure that the filling force of tobacco which is confined in such cigarettes increases sufficiently to reach, during testing, a value which is identical with or close to the final value. At any rate, the aforementioned interval should be long enough to enable the measuring or testing device 56 to ascertain the momentary filling force of the filler of the tested cigarette at a time when the measured value of the filling force is sufficiently close to the final value so that one can ascertain the final value of the filling force or that one can estimate such final value with a degree of certainty which is sufficient to allow for appropriate automatic adjustment of the quantity of tobacco in the stream 7*a* as a function of deviations of the final filling force from a desired or predetermined optimum value. The filling force at one end of each cigarette 20B is also reduced as a result of severing by the knife 37; therefore, the distance between the station 36 and the testing device 56 should be sufficient to enable the filling force to increase to the aforediscussed value which is identical with or at least close to the final value.

Figure 1A:
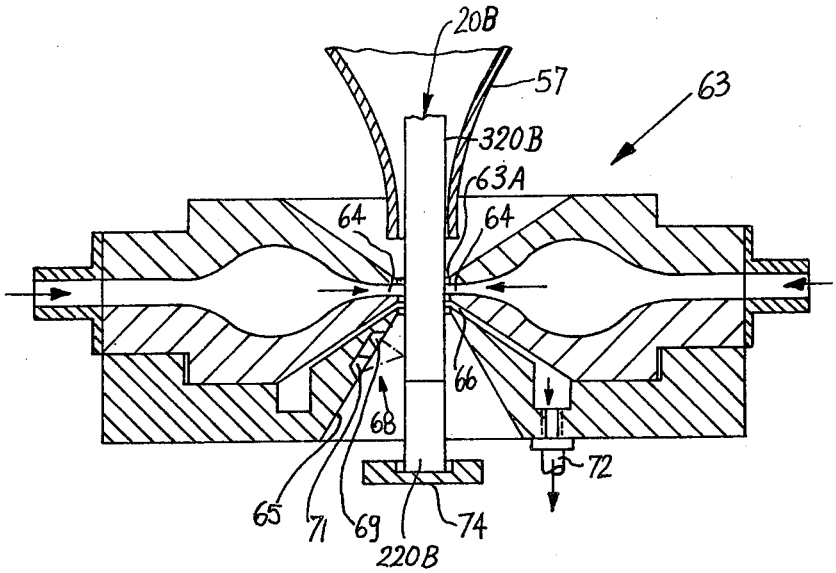
FIG. 1*a* is an enlarged axial sectional view of a testing device which can be utilized in the apparatus of FIG. 1 to ascertain the filling force of the fillers of discrete filter cigarettes.

The testing or measuring device 56 has a funnel-shaped inlet 57 wherein an oncoming filter cigarette 20B descends in such a way that the filter mouthpiece 220B is located at the lower end. The inlet 57 is located at a level above a ring-shaped testing nozzle 63 the details of which are shown in FIG. 1*a*. The nozzle 63 defines a vertical passage 63A wherein the cigarette 20B descends and the nozzle is further formed with a narrow annular clearance 64 which communicates with the passage 63A and receives a compressed gaseous testing fluid (preferably air) from a source 59 by way of a conduit 59A containing an electrically controllable shutoff valve 61 and a preferably adjustable flow restrictor 62. Compressed air which flows from the annular clearance 64 into the passage 63A deforms the tubular wrapper 320B of the cigarette 20B while the cigarette descends in the passage 63A, and the extent of deformation of the wrapper 320B (against the opposition of the confined compacted tobacco filler) is indicative of the filling force of the filler, i.e., of the force with which the compacted and confined filler bears against the internal surface of the wrapper 320B. The diameter of the passage 63A (and hence the inner diameter of the annular clearance 64) slightly exceeds the diameter of the wrapper 320B in undeformed condition of the cigarette.

It can be said that, as the cigarette 20B descends in the passage 63A, successive increments of its wrapper 320B are formed with ring-shaped constrictions (not specifically shown in FIG. 1*a*) which are identical if the filling force of the entire tobacco filler is constant or whose diameters vary in dependency on variations of the filling force of the filler in a direction from the lower toward the upper end of the tobacco-containing portion of the cigarette 20B in the passage 63A.

The flow restrictor 62 is adjusted in such a way that the extent of deformation of the wrapper 320B in the nozzle 63 is within the elastic range of the material of the filler, i.e., that the filler expands (the constriction disappears) immediately or shortly after the cigarette leaves the nozzle 63. Thus, the tested cigarette again constitutes or resembles an elongated rod of constant diameter. Such selection of pressure of the testing fluid is particularly desirable if the tested cigarettes 20B are to be further processed, e.g., by admitting them into the magazine of the packing machine PM for introduction into soft or flip-top packs.

As mentioned above, the extent of deformation of a portion of the wrapper 320B under the action of compressed testing fluid flowing from the annular clearance 64 into the passage 63A is indicative of the filling force of the corresponding portion of the filler. Therefore, by ascertaining the degree or extent of deformation, one can ascertain the filling force of the filler at the time the respective cigarette 20B descends in the nozzle 63. In order to ascertain the extent to which the wrapper 320B is deformed, one can monitor the pressure of testing fluid immediately downstream of the clearance 64 or in the clearance proper because such pressure varies with the extent to which the wrapper is deformed and allows testing fluid to flow from the clearance 64 into and from the passage 63A.

Another mode of ascertaining the extent of deformation of the wrapper 320B is shown in FIG. 1*a*. Thus, the nozzle 63 is formed with an annular groove 66 which communicates with the passage 63A immediately downstream of the locus of communication between the passage 63A and the clearance 64. The pressure of fluid which flows into the groove 66 is a reliable indicator of the extent of deformation of the corresponding portion of the wrapper 320B. Thus, the filling force is more pronounced when the pressure in the groove 66 is higher, and vice versa.

The valve 61 can be opened, via amplifier 67, by the output signal which is transmitted by a reflection type photoelectronic cell 68 installed in a conical portion 65 of the nozzle 63 at a level below the groove 66. The photodiode 69 of the cell 68 transmits a signal when the light beam issuing from the light source 71 of the cell 68 impinges upon white cigarette paper (i.e., the valve 61 can remain closed to prevent testing when the filter mouthpiece 220B of a cigarette 20B advances past the cell 68 provided, of course, that the convoluted uniting band 32 does not reflect a sufficient amount of light onto the photosensitive surface of the diode 69). The cell 68 insures that the valve 61 is open only during that interval when a selected cigarette 20B descends in the passage 63A of the nozzle 63.

A conduit 72 connects the annular groove 66 with a transducer 73 (e.g., a diaphragm transducer of the type disclosed in commonly owned U.S. Pat. No. 3,412,856 granted Nov. 26, 1968 to Albert Esenwein). The transducer transmits electric signals to a summing amplifier 81 shown in FIG. 1.

The filter plug 220B of a selected cigarette 20B which advances beyond the discharge end 58 of the belt conveyor 54 and descends in the inlet 57 and thereupon advances through the passage 63A descends onto the upper side or surface of a mobile stop 74 here shown as an arm which is attached to a vertically reciprocable toothed rack 76. The rack 76 is reciprocable in suitable bearings 76A, 76B and meshes with a pinion 77 which is driven by a reversible electric motor 78 by way of a belt transmission or the like. The motor 78 is mounted in or on the frame of the machine 2 or 1 and receives start, stop and reverse signals from an amplifier 79 of conventional design. The arrangement is such that the motor 78 is started in a direction to move the rack 76 and the arm 74 downwardly, as viewed in FIG. 1, when the input a of the amplifier 79 receives a signal from the output of the photodiode 69 of the cell 68. As mentioned above, the diode 69 transmits such signal when the cell 68 detects the presence of white wrapping material in the nozzle 63, i.e., when the testing operation is to begin. The motor 78 then drives the pinion 77 at a constant speed so that the cigarette 20B whose filter mouthpiece 220B rests on the arm 74 descends at a preselected speed and the testing fluid which issues from the clearance 64 deforms successive increments of the tubular wrapper 320B. The fluid which flows along the wrapper 320B enters the groove 66 and flows through the conduit 72 to effect the generation of a corresponding electric signal at the output of the transducer 73, i.e., such signal is indicative of the measured filling force of successive increments of the filler in the tubular wrapper 320B. The summing amplifier 81 totalizes the signals which are transmitted by the transducer 73 in the course of a testing operation, i.e., the signal at the output of the amplifier 81 denotes the integrated value of the filling force of an entire filler.

A limit switch 82 which is installed in the path of movement of the arm 74 transmits a signal when the testing operation is to be completed. Such signal is transmitted to the corresponding input of the amplifier 67 which erases the signal at the amplifier input which is connected with the photodiode 69 so that the valve 61 is closed as soon as the upper end of the cigarette 20B descends below the clearance 64 and groove 66. At the same time, the limit switch 82 transmits a signal to the amplifier 81 which transmits the integrated signal to an averaging circuit 83 whose output is connected with the aforementioned signal modifying or subtracting circuit 92 in the connection between the source 23 of reference signals and the input b of the signal comparing stage 22. The amplifier 81 is reset to zero as soon as the information which is stored therein is transmitted to the averaging circuit 83. Thus, the apparatus is ready for testing of the next selected cigarette 20B immediately after the arm 74 actuates the detector or limit switch 82.

The motor 78 continues to move the arm 74 downwardly after actuation of the limit switch 82 whereby the arm 74 engages and actuates a further limit switch 84 which transmits a signal to the input b of the amplifier 79. This causes the amplifier 79 to supply the motor 78 with voltage of opposite polarity so that the motor 78 rotates the pinion 77 in a clockwise direction, as viewed in FIG. 1, and causes the rack 76 to return the arm 74 to the upper end position or starting position in which the arm is ready to intercept the next cigarette 20B which advances beyond the discharge end 58 of the belt conveyor 54.

The upward movement of the arm 74 back to the starting position of FIG. 1 is preceeded by expulsion of the freshly tested cigarette 20B into an intercepting container 89, e.g., a chute which can direct freshly tested articles onto a conveyor for transport into the magazine of the packing machine PM. The transfer of freshly tested cigarettes 20B from the arm 74 into the container 89 is initiated by the signal which is generated by the limit switch 84 on actuation by the arm 74. Such signal is transmitted to the input b of the amplifier 79 (as described above) as well as to an amplifier 86 which causes a solenoid-operated valve 87 to open. The valve 87 is installed in a conduit 87A which connects the source 59 or another source of compressed air with a nozzle 88. The nozzle then discharges a blast of compressed air which propels the freshly tested cigarette 20B from the arm 74 into the container 89 before the arm 74 begins to move back toward the illustrated starting position. When the arm 74 reaches such starting position, it actuates a limit switch 91 which transmits a signal to the input c of the amplifier 79 to thereby arrest the motor 78.

The output signal of the averaging circuit 83 is transmitted to the subtracting circuit 92 wherein it is deducted from the reference signal which is transmitted by the source 23 of reference signals. The output signal of the subtracting circuit 92 constitutes the corrected reference signal and is transmitted to the input b of the signal comparing stage 22. Thus, the knife or knives of the equalizing device 12 are moved toward the conveyor 7B for the tobacco stream 7 when the filling force increases so that more tobacco is removed and, consequently, the finished cigarettes contain less tobacco. When the measured value of the filling force decreases, the knife or knives 10 of the equalizing device 12 are moved in the opposite direction, namely, away from the conveyor 7B, so that more tobacco remains in the stream **7*a* and the quantity of tobacco in the cigarettes 20 is increased. The subtracting circuit 29 has a lower threshold value for its output signal, i.e., the intensity of the output signal cannot decrease below such threshold value. This insures that the weight of the filler in each cigarette at least equals the prescribed minimum permissible weight. The averaging circuit 83 insures that the position of the knife or knives 10 is not changed in response to excessive deviation of filling force of a portion of the filler in a cigarette 20B** from the desired value.

In place of the illustrated ring-shaped testing nozzle 63, the filling force can also be measured in a different way. For example, it may be advantageous to ascertain the elastic deformation of a wrapped portion of the rod 16 by photoelectronic means in a manner as disclosed in British Pat. No. 1,422,991.

Another mode of regulating the quantity of material in the stream **7*a* includes adjustment of the mass of tobacco in the carpet or sliver which is formed by the distributor 3 of the cigarette making machine 1. The control connection between the signal comparing stage 22 and an adjustable variable-speed transmission 93 for the tobacco supplying conveyor 3A or another conveyor of the distributor 3 is indicated by a broken line 94. The details of such controls are adequately shown in U.S. Pat. No. 2,729,213 granted Jan. 3, 1956 to William C. Broekhuysen et al. so that a detailed description of such mode of regulating the quantity of tobacco in the stream 7*a*** is not necessary.

Figure 2:
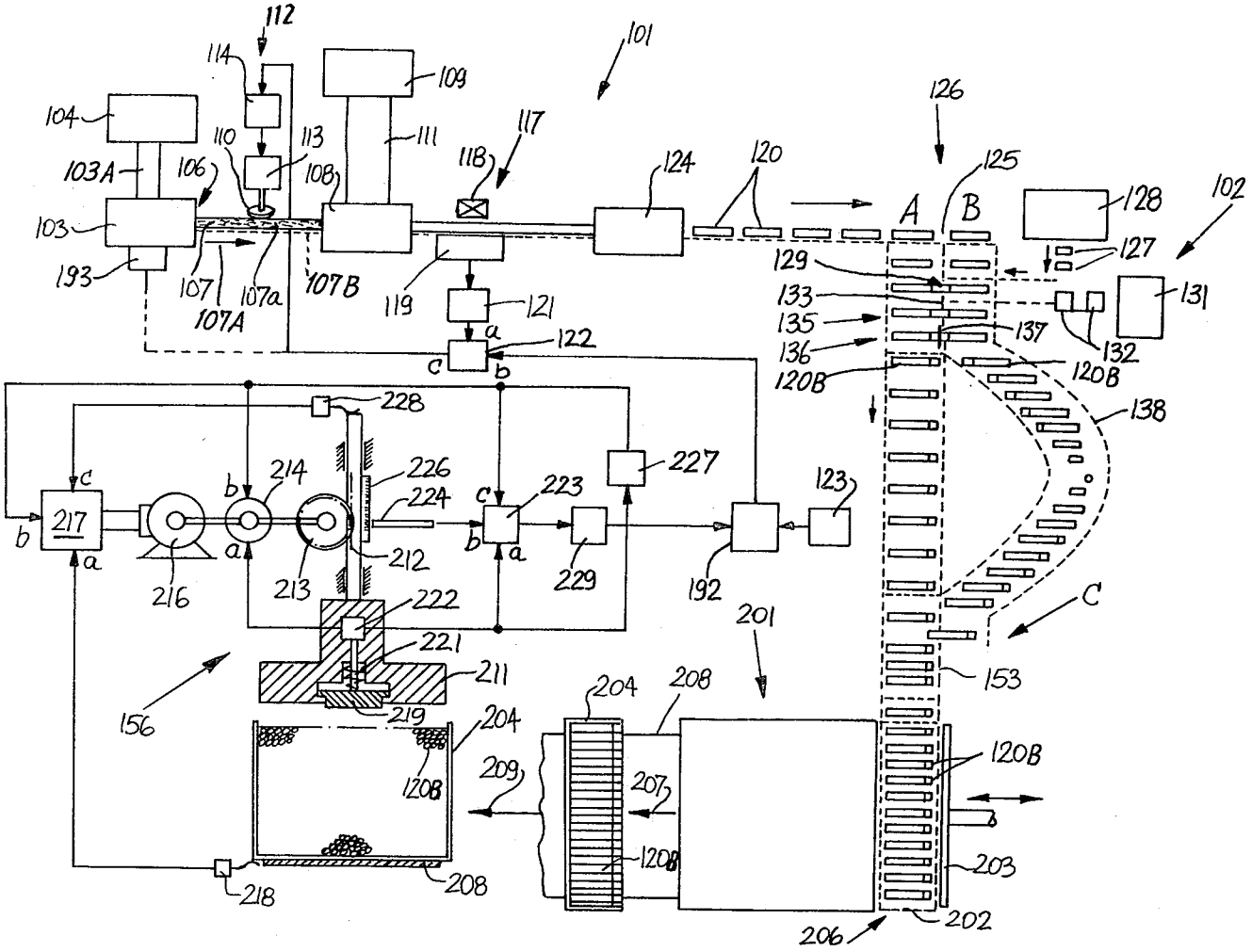
FIG. 2 illustrates a portion of a production line of the type shown in FIG. 1 and a modified apparatus which is constructed and assembled for simultaneous testing of stack of filter cigarettes.

FIG. 2 shows a modified apparatus which differs from the embodiments of FIGS. 1 and **1*a* essentially in that, instead of testing discrete cigarettes for determination of the filling force of tobacco which is contained therein, the testing device 156** of the modified apparatus can simultaneously test a predetermined number of cigarettes which are confined in a container, a so-called charger or tray. This mode of testing can be resorted to for ascertainment of the filling force of tobacco in all cigarettes which issue from the filter tipping machine.

Those components of the production line of FIG. 2 which are identical with or analogous to corresponding components of the production line of FIG. 1 are denoted by similar reference characters plus 100.

A comparison with FIG. 1 shows that the cigarette making machines 1, 101 and the filter tipping machines 2, 102 are of identical construction all the way to the respective turn-around devices 38 and 138. The turn-around device 138 of FIG. 2 deviates from the turn-around device 38 in that it tip-turns the cigarettes 120B of the row B and places the inverted cigarettes between the non-inverted cigarettes 120B of the row A.

The cigarettes 120B of the row C which are transported from the filter tipping machine 102 on a conveyor belt 153 are delivered to a charger filling machine 201 which is shown schematically in plan view. A charger filling machine which is especially suited for use in the production line of FIG. 2 is known in the cigarette industry under the name "CASCADE" (produced by Hauni-Werke) and is described in detail in U.S. Pat. No. 3,308,600 granted Mar. 14, 1967 to Otto Erdmann et al. The reason that the machine 201 is especially suited for determination of filling force in a manner to be described below is that its suction head which is indicated at 202 invariably removes from the conveyor belt 153 a predetermined number of filter cigarettes 120B and sucks them upwardly into flutes which are adjacent to each other. Thus, during each filling stroke of a transfer member or pusher 203, a full row which contains a fixed number of filter cigarettes 120B is introduced into a charger 204 so that, when filled and transferred from the filling station 206 onto a belt conveyor 208 which advances in the direction indicated by arrow 207, the charger 204 invariably contains a block or stack consisting of a predetermined number of arrayed filter cigarettes 120B (e.g., 6000 or 8000 cigarettes). Since the individual rows are placed on top of each other while laterally offset by one-half of a cigarette diameter so that the individual cigarettes of one row are always deposited in the gaps between the cigarettes of the row therebelow, the filled charger 204 contains a highly homogenous block or stack which, therefore, is suited for simultaneous determination of the filling force of tobacco in all cigarettes therein.

For the sake of clearer illustration of the testing device, the charger 204 downstream of the arrow 209 is turned through 180 degrees so that is can be seen in front elevation as viewed in the direction of arrow 207.

The testing device 156 of FIG. 2 comprises a plate-like weight 211 whose width corresponds to the width of the cigarette stack in the filled charger 204. The weight 211 can be moved up and down by a toothed rack 212 and a pinion 213 which latter can be driven by an electric motor 216 by way of an electrically controllable clutch 214.

When the filled charger 204 reaches the illustrated testing position, the input a of a control circuit 217 for the motor 216 receives a signal from a limit switch 218 which simultaneously arrests the drive for the conveyor belt 208. The control circuit 217 then supplies to the motor 216 voltage which initiates rotary movement in a direction to lower the weight 211. As soon as the weight 211 descends onto the cigarette stack in the filled charger 204, a plate-like sensor 219 (recessed into the underside of the weight 211) is displaced against the opposition of a spring 221 and thereby actuates a switch 222. This switch 222 transmits a signal to the input a of the clutch 214 whereby the power flow between the motor 216 and the pinion 213 is interrupted so that the weight 211 is released and its mass can apply a deforming stress to the cigarette stack therebelow. The distance which the weight 211 thereupon covers depends on the filling force of tobacco which is contained in the cigarettes of the stack so that one can ascertain the filling force on the basis of measurement of such distance.

For the purpose of measuring the distance, the signal which is transmitted in response to closing of the switch 222 is further transmitted to the input a of a counter 223 to prepare the counter for reception of distance denoting signals at its input b. The distance denoting signals are transmitted by a stationary reflection type photoelectronic cell 224 which monitors a graduated raster 226 connected to the rack 212 and moving along the cell 224. The cell transmits a signal on detection of each graduation of the raster 226, and such signals are transmited to and counted by the counter 223. Rasters with strip-shaped graduations and associated monitoring means for measuring the distances covered by mobile parts are well known, especially in machine tools.

The number of counted signals, i.e., the condition of the counter 223 after elapse of the measuring interval, is indicative of the distance covered by the weight 211 which thereby slightly reduces the height of the stack in the filled charger 204. Since this distance is a function of the filling force, it is indicative of the filling force proper. Actually, the distance is indicative of the average value of filling force of the fillers of all tested articles 20B in a charger 204.

The means for terminating the measuring interval comprises a time-delay device 227 which delays the signal supplied thereto on actuation of the switch 222 and thereupon transmits the signal to the input c of the counter 223 whereby the information which is stored in the counter is transmitted to a storage 229 and the counter is simultaneously restored to its initial condition.

The output signal of the time-delay device 227 is further transmitted to the input b of the control circuit 217 which thereupon supplies to the electric motor 216 voltage of opposite polarity so that the motor is started and rotates in the opposite direction. Since the output signal of the time-delay device 227 is also transmitted to the input b of the clutch 214 and has caused engagement of the clutch, the rack 212 is moved upwardly until a limit switch 228 transmits a signal to the input c of the circuit 217 to terminate the supply of energy so that the motor 216 comes to a halt. A brake, not shown, which is actuated at the same time prevents unintentional lowering of the weight 211. Furthermore, and since the signal which has been generated as a result of closing of the switch 222 disappears, further counting by the counter 223 of signals which are transmitted by the cell 224 is impossible. The limit switch 228 thereupon starts the drive means for the transporting belt 208 so that the charger 204 which contains tested articles is removed from the range of the testing device 156 and the latter is available for the next-following charger. The testing device 156 can test the contents of each and every filled charger or the contents of each n-th charger.

The signal which is stored in the storage 229 and denotes the measured filling force, and which corresponds to the integrated value (comparable to average value signal furnished by the circuit 83 of FIG. 1), is again transmitted to a subtracting or modifying circuit 192 wherein it is deducted from the reference signal supplied by the source 123 of reference signals. In a manner as shown in FIG. 1, the quantity of tobacco in the stream **107*a* is regulated via signal comparing stage 122 in dependency on the measured filling force, namely, either by adjustment of the regulating means including the equalizing device 112 or by adjustment of the distributor 103 in the cigarette making machine 101**.

The integrated measured values of filling force for tobacco in cigarettes 120B which are confined in a charger 204 can be used, as in FIG. 1, for calculation of average values by means of an averaging circuit (not shown) which average values serve to influence the quantity of material in the stream **107*a***.

If the ultimate products are plain cigarettes, the testing device 56 or 156 receives some or all of the articles which issue from the cigarette making machine 1 or 101. It is further clear that the device 56 or 156 can test the plain cigarettes 20 or 120 prior to introduction of such cigarettes into the filter tipping machine 2 or 102.

The aforementioned interval of at least one second and preferably more than three seconds can be greatly exceeded. This further insures that the measured filling force is close to or matches the final filling force, namely, the filling force which is ascertained by the purchaser prior to or during smoking.

An important advantage of the improved method and apparatus is that the manufacture of cigarettes can be regulated not only in dependency on the mass of tobacco (which is not a satisfactory indicator of the quality of cigarettes) but also that the regulation is influenced, in a fully automatic way, by measured values of the filling force and that the measured values denote the actually achieved filling force, i.e., the measured values at least approximate the final value of the filling force.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A method of processing elastically deformable smokable particulate material, especially tobacco, comprising the steps of converting smokable material into a continuous stream; moving the stream lengthwise; compacting the moving stream and applying around the moving compacted stream a continuous wrapper whereby the material of the compacted stream tends to expand and exerts a force against the interior of the applied wrapper; subdividing the moving wrapped stream into discrete rod-shaped articles while said force is on the increase, at least at times, toward a final value; measuring said force in at least some of the articles with a delay following the completion of said subdividing step and long enough to allow said force to reach a value sufficiently close to said final value for ascertainment of said final value on the basis of the measured value of said force; and regulating the quantity of material in said stream prior to wrapping as a function of the measured value of said force, including reducing the quantity when the measured value increases and vice versa.

2. A method as defined in claim 1, wherein said delay is at least one second.

3. A method as defined in claim 1, wherein said delay is at least three seconds.

4. A method as defined in claim 1, wherein said measuring step includes testing a fraction of the total number of articles which the wrapped stream yields as a result of said subdividing step.

5. A method as defined in claim 4, further comprising the step of conveying said discrete articles along a predetermined path, said measuring step comprising testing each n-th article of the articles which are conveyed along said path.

6. A method as defined in claim 1, wherein said measuring step comprises directing a stream of pressurized fluid against the wrappers of the articles and monitoring the extent of deformation of the wrappers under the action of the fluid stream.

7. A method as defined in claim 6, wherein said fluid stream is a compressed air stream.

8. A method as defined in claim 1, wherein said measuring step comprises testing successive increments of articles and generating first signals denoting the filling force of each tested increment of an article, and further comprising the step of generating a second signal denoting the average intensity of said first signals, said regulating step including varying the quantity of material in said stream as a function of the extent of deviation of the intensity of each second signal from a reference signal of predetermined intensity.

9. A method as defined in claim 1, wherein said measuring step comprises simultaneously testing a plurality of articles.

10. A method as defined in claim 9, wherein said measuring step comprises simultaneous application of a deforming stress to said plurality of articles and monitoring the changes in the combined volume of said plurality of articles in response to the application of said deforming stress.

11. A method as defined in claim 10, further comprising the step of arraying said plurality of articles in the form of a stack prior to said stress-applying step.

12. A method as defined in claim 1, wherein said regulating step includes removing from said stream material at a rate which is a function of the measured value of said filling force.

13. A method as defined in claim 1, wherein said converting step comprises forming a continuous moving carpet of smokable material and converting the carpet into said continuous stream, said regulating step comprising varying the quantity of material per unit length of the carpet as a function of the measured value of said force.

14. A method as defined in claim 1, further comprising the steps of generating first signals denoting the quantity of material per unit length of said stream and comparing said first signals with a reference signal denoting the desired quantity of material per unit length of said stream, said regulating step further comprising varying the quantity of material in said stream when a first signal deviates from said reference signal.

15. A method as defined in claim 14, wherein said step of generating said first signals comprises directing a beam of corpuscular radiation against successive increments of said stream and monitoring the intensity of radiation which penetrates through the respective increments of said stream.

16. A method as defined in claim 14, wherein said measuring step comprises generating third signals denoting the filling force of tested articles and said regulating step further comprises modifying said reference signal when the intensity of said third signal deviates from a predetermined value.

17. A method as defined in claim 16, wherein said modifying step includes increasing the intensity of said reference signal when the intensity of said third signal is below said predetermined value and vice versa.

18. A method as defined in claim 17, further comprising the step of interrupting said modifying step when the measured quantity of material drops to a predetermined lower threshold value.

19. A method as defined in claim 1, further comprising the step of attaching a rod-shaped component to each article prior to said measuring step.

20. Apparatus for processing elastically deformable smokable particulate material, especially tobacco, comprising a source of particulate material; means for conveying a continuous stream of particulate material from said source; means for applying a wrapper around the moving stream, including means for compacting the material of the stream whereby the compacted material tends to expand and exerts an increasing force against the interior of the applied wrapper; means for severing the moving wrapped stream to form discrete rod-shaped articles while said force increases, at least at times, toward a final value; means for testing at least some of said articles, including means for measuring said force; means for delaying the testing of articles so that the interval between compacting and testing is long enough to enable said force to increase to a value sufficiently close to the final value for ascertainment of said final value on the basis of the measured value of said force; and means for regulating the quantity of material in said stream prior to wrapping as a function of the measured value of said force so that the quantity is reduced when the measured force increases and vice versa.

21. Apparatus as defined in claim 20, wherein said delaying means comprises means for transporting the articles to be tested from said severing means to said testing means.

22. Apparatus as defined in claim 21, wherein the interval which elapses during transport of articles between said severing means and said testing means is at least one second.

23. Apparatus as defined in claim 21, wherein the interval which elapses during transport of articles between said severing means and said testing means exceeds three seconds.

24. Apparatus as defined in claim 20, further comprising means for conveying severed articles along a predetermined path, said delaying means comprising means for transporting the articles to be tested from a predetermined portion of said path to said testing means.

25. Apparatus as defined in claim 24, further comprising means for transferring each n-th article in said path from said predetermined portion of said transporting means.

26. Apparatus as defined in claim 20, wherein said testing means comprises a source of compressed gas, means connected with said source and operative to direct compressed gas against the wrappers of articles to be tested whereby the wrappers are deformed to an extend which is a function of said force, and means for monitoring the extent of deformation of the wrappers of tested articles.

27. Apparatus as defined in claim 26, wherein said means to direct comprises a nozzle having an annular passage for articles and an annular clearance surrounding said passage and communicating with said last mentioned source.

28. Apparatus as defined in claim 20, wherein said testing means includes means for testing a plurality of portions of each tested article and for generating a plurality of first signals each denoting the measured force in a different portion of such article, and further comprising means for generating a second signal denoting the average value of said first signals and for transmitting said second signal to said regulating means.

29. Apparatus as defined in claim 20, wherein said delaying means comprises means for accumulating seriatim groups consisting of predetermined numbers of articles and said measuring means comprises means for simultaneously ascertaining said force in each of a complete group of articles.

30. Apparatus as defined in claim 29, wherein said testing means further comprises means for applying a predetermined volume-reducing stress to each of successive groups of articles and said measuring means comprises means for ascertaining the reduction of the volume of each group.

31. Apparatus as defined in claim 20, wherein said regulating means comprises adjustable means for removing material from said stream and means for adjusting said removing means as a function of the measured value of said force.

32. Apparatus as defined in claim 31, wherein said removing means comprises a trimming device and said adjusting means comprises means for moving said trimming device with respect to said stream.

33. Apparatus as defined in claim 20, wherein said conveying means comprises adjustable means for removing material from said source and for converting the removed material into a carpet and means for converting said carpet into said stream, said regulating means comprising means for adjusting said removing means as a function of the measured value of said force.

34. Apparatus as defined in claim 33, wherein said removing means is a distributor.

35. Apparatus as defined in claim 20, further comprising means for monitoring the quantity of material in successive increments of said stream and for generating first signals denoting the monitored quantities of material, a source of reference signals, means for comparing said first signals with said reference signals and for transmitting third signals denoting the deviations of said first signals from said reference signals, and means for adjusting said conveying means in response to said third signals, said regulating means comprising means for modifying one of said signals as a function of variations of said measured force.

36. Apparatus as defined in claim 35, wherein said regulating means comprises means for modifying said reference signals so as to intensify said reference signals when the measured value decreases and vice versa.

37. Apparatus as defined in claim 36, wherein said material consists primarily of tobacco shreds.

38. Apparatus as defined in claim 20, further comprising means for attaching to each article a rod-shaped component ahead of said testing means.

39. Apparatus as defined in claim 20, wherein said stream is a rod-like filler.

* * * * *